United States Patent [19]

Mehta et al.

[11] 4,397,248

[45] Aug. 9, 1983

[54] COAL BENEFICIATION/COMBUSTION SYSTEM

[75] Inventors: Arun K. Mehta, East Granby; Richard W. Borio, Sommers, both of Conn.

[73] Assignee: Combustion Engineering, Inc., Windsor, Conn.

[21] Appl. No.: 266,770

[22] Filed: May 26, 1981

[51] Int. Cl.[3] ..... F23D 1/00

[52] U.S. Cl. ..... 110/263; 110/106; 110/232; 110/342; 110/347

[58] Field of Search ..... 110/342, 343, 347, 232, 110/245, 263, 210, 211, 219, 220, 222, 106

[56] References Cited

U.S. PATENT DOCUMENTS

| | | | |
|---|---|---|---|
| 3,250,016 | 5/1966 | Agarwal | 110/232 |
| 3,951,081 | 4/1976 | Martin et al. | 110/222 |
| 4,236,886 | 12/1980 | Ansen et al. | 110/347 |
| 4,259,911 | 4/1981 | Jones | 110/245 |

*Primary Examiner*—Edward G. Favors
*Assistant Examiner*—Steven E. Warner
*Attorney, Agent, or Firm*—Arthur L. Wade

[57] ABSTRACT

A system receives raw coal which is routed through crushing, screening, pulverizing, classifying, and beneficiation stages with the de-mineralized fraction of the coal routed to a pulverized-coal-fired furnace, while the mineralized fraction is routed to a fluidized bed furnace.

4 Claims, 1 Drawing Figure

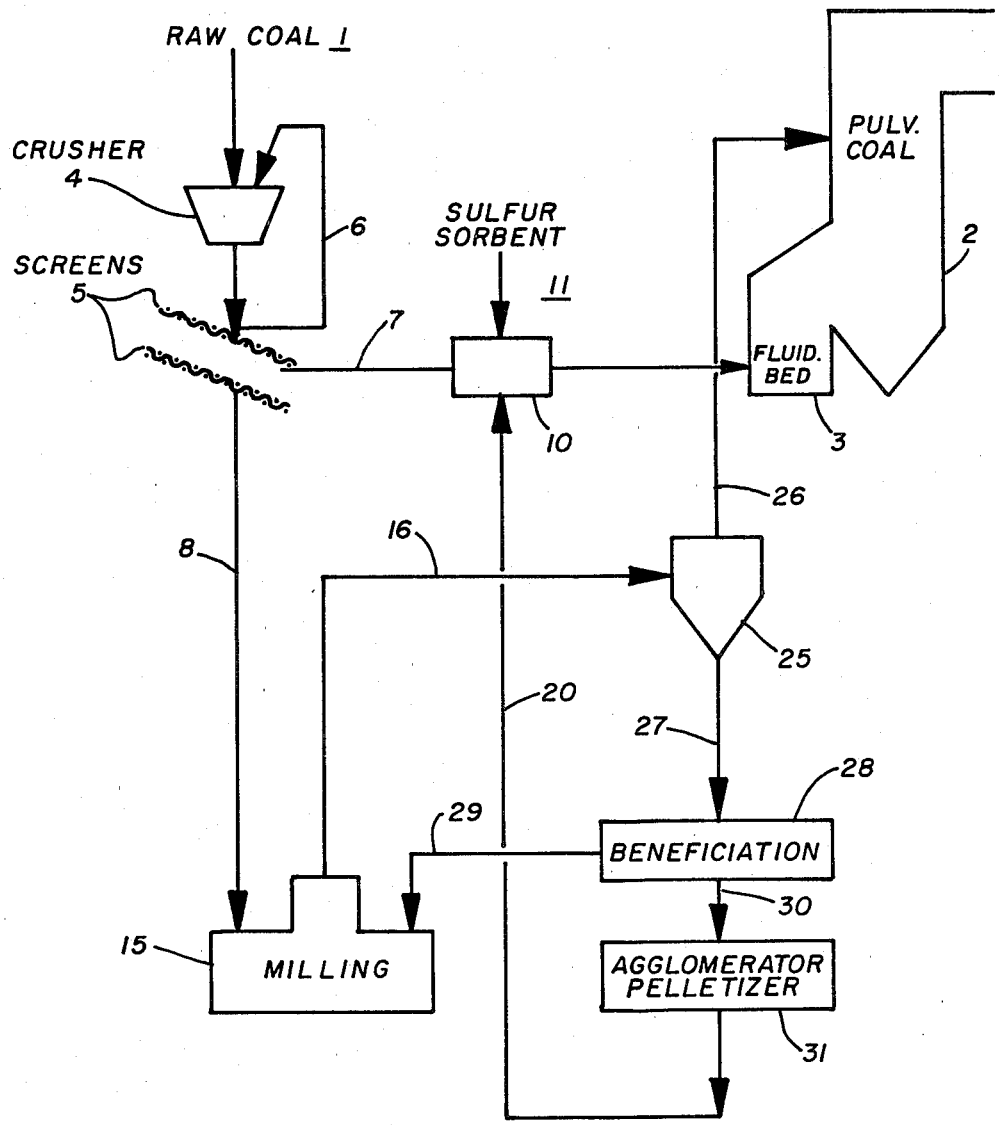
RAW COAL 1
CRUSHER
4
6
SCREENS
5
7
SULFUR
SORBENT
11
10
PULV.
COAL
2
FLUID.
BED
3
26
8
16
25
20
27
28
29
BENEFICIATION
30
15
MILLING
AGGLOMERATOR
PELLETIZER
31

COAL BENEFICIATION/COMBUSTION SYSTEM

TECHNICAL FIELD

The present invention relates to the separation of the mineral content of coal and the combustion of the coal in a plurality of furnaces. More particularly, the invention relates to processing coal in a system which stages the extraction of the mineral content of the coal, the higher grade of coal from each stage being directed into a pulverized-coal-fired furnace, while the lower grade of coal containing the higher mineral content is consumed in a fluidized bed furnace.

BACKGROUND ART

Many attempts in the past have been made to perform beneficiation on coal in order to extract the portion of the coal which will give the cleanest combustion process to keep undesirable emissions (such as sulfur dioxide) to a minimum, and minimize ash slagging and fouling problems. The problem facing the coal preparation engineer is the difficult removal of all minerals and sulfur from coal. Stated another way, it must be accepted that present techniques with which to eliminate the mineral and sulfur constituents of coal also eliminate an economically significant percentage of the consumable part of the coal. Obviously, this economic penalty of coal loss is often unacceptable. If a combustion process can utilize the "dirty" fraction of the total supply concomitant with the consumption of the "clean" fraction, a deep cleaning procedure, or "cream skimming", can be justified. Again, in other words, the problem is to provide a system which will concomitantly utilize both the dirty and clean fractions of the total supply of coal to economic advantage.

Setting aside the availability of anthracitic coal, the principal fuel factor in pulverized-coal-fired boiler design is the characteristics of the coal ash behavior. Ironically, those coals in the U.S., with the higher reactivity, require larger furnaces because the mineral matter in these coals (lower rank) is such that they require lower furnace temperatures to prevent slagging/fouling problems. Obviously, in these boilers, clean coal combustion will enable the reduction of their size and cost. Conversely, fluidized bed combustor design, as compared to pulverized-coal-fired boiler design, is relatively unaffected by the quantity and quality of coal mineral matter. Temperatures in typical fluidized bed combustors are maintained at 1550 F. This is below the initial melting temperature of practically all coal ash, thereby obviating problems due to ash slagging/fouling. Additionally, fluidized beds can be operated with limestone, or dolomite, mixed with the coal in the bed material to provide sulfur capture in the bed. From the standpoint of fuel properties, then, the fluidized bed combustor can much more easily tolerate a dirty fuel without the need for enlarging the combustor, or making other modifications specifically to accommodate the dirty fuel. In summation, what is needed is a system for processing raw coal and supplying it, as fuel, to a pulverized-coal-fired furnace and a fluidized bed furnace for plenary combustion of the coal.

DECLARATION OF THE INVENTION

The present invention contemplates the concomitant supply, in parallel, of coal as a fuel to a pulverized-coal-fired furnace, and a furnace fired by a fluidized bed. The common supply of coal has a significant mineral content. The coal is first crushed and screened to give a degree of separation of the coal into two portions with a differential mineralization. The portion of the coal with the higher mineralization is processed and fed to the fluidized bed. The portion of the coal with the lesser mineralization is processed for the supply of a relatively high-grade coal to the pulverized-coal-fired furnace. As the second portion of the coal is progressively de-mineralized, the portion of the coal, increasingly enriched in mineral matter, is routed to the fluidized bed.

The invention further contemplates progressively demineralizing the second portion of the coal, crushed and screened, by milling and classifying the coal to de-mineralize the supply to the pulverized-coal-fired furnace. The mineralized remnant of the second portion of the coal is subjected to beneficiation to extract additional coal sufficiently de-mineralized and/or desulfurized for re-milling and subsequent combustion in the pulverized-coal-fired furnace. The reject of the beneficiation process, enriched in mineral matter and sulfur, is agglomerated/pelletized and routed to the fluidized bed.

Other objects, advantages and features of this invention will become apparent to one skilled in the art upon consideration of the written specification, appended claims, and attached drawing.

BRIEF DESIGNATION OF THE DRAWING

The drawing is a schematic of a system in which raw coal is processed into separate fuel supplies for two furnaces, all of which such system embodies the present invention.

BEST MODE FOR CARRYING OUT THE INVENTION

General Plan

In the drawing, an admittedly amorphous indication is given to a source 1 of raw coal. The raw coal from this source 1 contains a significant amount of minerals which has little or no B.T.U. value and, additionally, is abrasive. The requirement is to burn all of the coal, or at least a very high percentage of the coal, to generate heat which can be transduced into useful energy.

It is a concept of the present invention to separate the raw coal into a first fraction which contains a minimum of abrasive and non-combustible minerals, and a second fraction containing the larger portion of the minerals. The first fraction is routed for combustion in the pulverized-coal (p.c.)-fired furnace 2, and the second fraction is earmarked for consumption in the fluidized bed of furnace 3. It is not necessary, for the present disclosure, to describe the function of each of the furnaces 2 and 3 in detail. It is sufficient to understand that furnace 2 can be readily designed if the coal burned in it will produce relatively little ash and slag which will coat its heat exchange surfaces to reduce its efficiency. The fluidized bed furnace 3, for the purposes of the present disclosure, can be regarded as the slop chest of the two furnaces. The coal received into the fluidized bed is expected to consist of that portion of the coal whose grade is lowered by the larger quantity of minerals. It is expected, therefore, that significant ash will have to be continuously removed from furnace 3.

The system is expected to receive a synergistic effect from having the fluegas routed from furnace 3 through furnace 2. The expectation is, that the elutriated, unburned carbon in the fluegas of furnace 3 will be consumed in furnace 2 before the convection pass of furnace 2 is reached. However, the broad concept of the invention, in efficiently utilizing the heating value within the mineralized coal source, is not limited by necessarily including this synergistic effect.

Competent coupling of a fluidized bed combustor with a conventional boiler provides means of eliminating weaknesses that either might have, if used alone. One common weakness of a fluidized bed is the unburned combustible. Combustion efficiencies are generally several points below a typical pulverized-coal-fired boiler at best. By virtue of feeding a very clean coal to the conventional boiler, the probability of slagging on the lower furnace walls would be greatly reduced. Further, by virtue of feeding a beneficiated, clean coal containing much smaller fractions of abrasives and relatively hard-to-grind mineral matter, to the pulverizer, mill wear and mill power consumption will be considerably reduced.

First Stage of Coal Preparation

Duly descending from the supply 1, a stream of raw coal is fed to a selective crusher at 4. In this first device for physically reducing the size of the raw coal, that part of the coal containing the greater quantity of minerals will not be reduced to the size of those coal particles containing a lesser amount of minerals. Therefore, the output of crusher 4 can be screened in a first rough cut between the high grade fraction of coal and the lower grade fraction of coal from source 1. In other words, the two portions of coal will have a large differential in their mineralization.

Screening structure at 5 is indicated diagrammatically as a slanted double screen. The top screen has holes about $\frac{1}{4}''$ in diameter, and the bottom screen has holes about $\frac{1}{8}''$ in diameter. This size range of $-\frac{1}{4}'' + \frac{1}{8}''$ is the current state of the art's best estimate for fuel size for a coal-fired fluid bed combustion, but could be adjusted as the practice changes. A vibratory structure may be provided to agitate the slanted screens to facilitate the separation of the different sizes. The oversize particles from the top screen are re-cycled by way of path 6 to crusher 4. The oversize particles from the bottom screen are routed through path 7 to the fluidized bed furnace 3. The downwardly directed path 8 is indicated as receiving the higher grade, or undersized, coal particles, while path 7 is indicated as receiving the lower grade, or oversized, particles. Thus, paths 8 and 7 represent the first division of the raw coal. Ultimately, the path 7 leads to the fluidized bed of furnace 3. Alternatively, at the end of path 8 are the windboxes of furnace 2. However, both of these paths include additional processing structure for the coal. Particularly, path 8 is provided structure which progressively separates the minor mineral content this portion of the coal contains. Beyond this first stage, fractions of the coal in path 8 are cumulatively enriched with the minerals. The basic purpose of the system is to provide two portions of the raw coal with differential mineral content, the portion with the higher mineral content being fed to the fluidized bed furnace and the portion with the lesser mineral content progressively processed to purge it of its mineral remnant until the high-grade fuel product which results can be fed to the pulverized-coal-fired furnace.

Processing The Coal Portion of Higher Mineralization

Path 7 symbolizes the conduction of the larger coal size from screen structure at 5 to a sorbent mixer at 10. Mixer 10 may be part of the system which combines a sulfur sorbent, such as limestone, dolomite, lime, etc., from a source 11 with the substandard coal prior to its distribution into the fluidized bed. It is well-known, and need not be elaborated here, that sorbent material, such as limestone, is commonly combined with fluidized bed fuel to capture sulfur compounds. This material prevents the sulfur compounds from being discharged in the fluegas flowing from the fluidized bed. Path 7 is identified as extending from the screen 5, through mixer 10, and on to fluidized bed 3. Any fraction subsequently processed from path 8, which is suitable for the bed of furnace 3, may join path 7 by way of path 20.

Processing The Coal Portion of Lesser Mineralization

Descending path 8 leads from the first stage screen down into mill system 15. "Mill" is the term which is used to indicate the general form of structure receiving the high-grade coal of path 8 to further reduce the coal in size for the windbox for furnace 2. The mill may be of a bowl, ball, or other type. To the present embodiment of the invention, it matters little how this coal fraction of path 8 is mechanically reduced in size. Whatever the specific type of mill, it is adjustable to given an output to path 16 which contains fractions of coal to be ultimately routed to the windbox of furnace 2. This output of path 16 is fed to a classifier system 25. It is expected that the classifier is a centrifugal type which receives a mixture of air and coal crushed in mill 15. This mixture is injected tangentially within a chamber so that the larger components of the coal are directed down into output path 27, while the smaller components are directed up into path 26. A combination of such classifiers, or other types of classification systems, could be utilized, as well.

Path 26 connects with the windbox of furnace 2. The degree of purity of the coal delivered to path 26 may vary, but it is expected to be essentially de-mineralized and fully combustible in furnace 2 with only minimal ash and slag residue. However, there are still valuable fractions of coal rejected downwardly by classifier 25 which the present system extracts for combustion in furnaces 2 and 3.

The descending material from classifier 25, in path 27, contains substantially all the minerals in the output of mill 15. A beneficiation structure 28 is provided to receive the material from path 27. Whether by electrostatic, magnetic, microwave, or other suitable force, beneficiation is carried out on the mineralized coal of path 27. Path 29 represents the flow of de-mineralized coal extracted from beneficiation structure 28. In all probability, the coal in path 29 is not sized small enough for the windbox of furnace 2, therefore, it is re-cycled into mill 15 for further size reduction.

A second output 30 is disclosed for beneficiation structure 28. In expectation that this output will contain middlings suitable for combustion on the bed of furnace 3, an agglomerator/pelletizer 31 is disclosed as receiving this coal with a high mineral content. The agglomerator/pelletizer 31 will bond the fine particles in stream 30 into larger particles of a size range suitable for burning in the fluid bed of furnace 3. This bonding process may be achieved, for example, by use of heat in the case of agglomerating coals, or by use of a suitable binder for non-agglomerating coals. Any other process for agglomerating/pelletizing the fine particles may, however, be used. The output of agglomerator/pelletizer 31 is disclosed as connected to path 20 to give an ultimate destination at the bed of furnace 3.

Conclusion

The present invention withdraws coal from a source containing minerals which have no thermal energy, and are potentially abrasive, and burns the coal in two separate furnaces. The process of division includes staging the withdrawal of minerals from the coal, with the de-mineralized fraction being burned in a "clean" furnace, and the subnormal, substandard, mineralized fraction of the coal is, in effect, a residue suitable for combustion on a fluidized bed. With the mosaic stroke in dividing the waters of the Red Sea, the raw coal is divided by the process in order to efficiently utilize both portions in separate furnaces. Certain weaknesses of both types of furnaces are circumvented, while the strengths of both types of furnaces are utilized.

It is contemplated that elutriated, unburned carbon particles from the fluidized bed will be passed into the pulverized-coal-fired furnace for more complete combustion. This final provision for completing the combustion of all possible usable elements of the coal completes the cycle of efficient operation.

In still another sense, the invention is found in the provision of two separate paths down which the coal is supplied to separate furnaces. The raw coal, with its minerals, is initially sized and screened to shove the more mineralized portion of coal down the first path toward the furnace utilizing a fluidized bed. The second path receives the remainder of the coal, significantly reduced in mineral content. The coal in each path is processed in various ways to more positively shuttle the mineralized coal portion into the first path and to clean the coal in the second path so the final product will burn most efficiently in the pulverized-coal-fired furnace. Sulfur sorbent is mixed with the coal in the first path to prepare for retaining the sulfur compounds in the fluidized bed. The coal in the second path is milled, classified, and beneficiated to extract all of the clean coal for the second path which can be reasonably expected with the present technology. Of course, as the minerals are concentrated in the remnant coal portion, this residue is diverted into the first path with its fluidized bed destination. Finally, the furnaces, themselves, are linked together so the fluidized bed vapor discharge will flow through the clean furnace in rounding out complete utilization of the heating value of the coal.

From the foregoing, it will be seen that this invention is one well adapted to attain all of the ends and objects hereinabove set forth, together with other advantages which are obvious and inherent to the method and apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawing is to be interpreted in an illustrative and not in a limiting sense.

We claim:

1. A combustion system for mineralized coal, including, a supply of mineralized coal, a first furnace sized and arranged to burn pulverized coal which has been substantially cleaned of its mineral content, a second furnace sized and arranged to burn coal with a relatively high mineral content on a fluidized bed, means connected to the supply of mineralized coal arranged to crush and screen the coal into two separate portions having a substantial difference in their mineral content, means connected to the crushing and screening means for supplying the portion of coal having the greater mineral content to the fluidized bed of the second furnace, milling means connected to the crushing and screening means to receive the portion of coal having the lesser mineral content to reduce the size of the coal toward that size required for combustion in the first furnace, a centrifugal type classifier connected to the mill to receive and further de-mineralize the milled coal, a first output conduit from the classifier connected to the first furnace to supply the substantially de-mineralized coal to the first furnace, a second output conduit from the classifier, a beneficiation structure connected to the second output conduit of the classifier to receive the mineralized portion of the milled coal, a first output conduit of the beneficiation structure connected to the first furnace to supply de-mineralized coal for combustion in the first furnace, a second output conduit from the beneficiation structure, and an agglomerator/pelletizing structure connected to the second output conduit of the beneficiation structure to receive and agglomerate/pelletize the mineralized coal and supply this coal to the second furnace for combustion.

2. A system for supplying coal to a first furnace adapted to burn substantially de-mineralized and pulverized coal and a second furnace adapted to burn mineralized coal in a fluidized bed, including, a supply of raw coal containing a significant amount of minerals, a first crusher connected to the coal supply to reduce the coal in particle size, a screen structure connected to the first crusher to receive the crushed coal and divide it into two streams with a significant differential in mineral content, a supply of sulfur sorbent connected to the higher mineral content coal stream of the screen system to capture sulfur compounds by the sulfur sorbent in the fluidized bed in which the coal is burned, a mill connected to the screen structure to receive the coal stream of lesser mineral content to reduce the coal of the stream toward the size suitable to be burned in the first furnace, a classifier structure connected to the mill to receive the sized coal from the mill and divide the sized coal into a first portion of coal substantially cleaned of minerals and sized for combustion in the first furnace and a second portion of mineralized coal, a conduit connected to the classifier structure to supply the clean coal to the first furnace, a beneficiation system connected to the classifier to receive the second portion from the classifier to separate the coal into a portion larger in size than can be burned in the first furnace and a second portion of mineralized coal, a conduit connected between the beneficiation system and the mill to recycle the larger size coal portion to the mill, and an agglomerator/pelletizer structure connected between the beneficiation system and the second furnace to agglomerate/pelletize the mineralized coal and supply the coal to the second furnace.

3. The method of burning mineralized coal, including, crushing and screening mineralized coal into a first portion of coal containing a relatively high mineral content and a second portion of coal containing a relatively low mineral content, mixing the first portion of mineralized coal with sulfur sorbent, conducting the mixture of mineralized coal and sulfur sorbent to a first furnace containing a fluidized bed structure adapted to burn the mixture, conducting the second portion of crushed and screened coal to a mill in which the coal is reduced toward the size suitable for combustions in a second furnace adapted to burn pulverized coal substantially cleaned of mineral content, centrifugally separating the milled coal into a first portion of substantially de-mineralized coal sized for combustion in the second furnace and a second portion of mineralized coal containing coal too large for combustion in the second furnace, recycling the large coal of the second portion from the centrifugal separator to the mill for size reduction, and agglomerating/pelletizing the minalized coal from the centrifugal separation and supplying the coal to the first furnace.

4. The method of claim 3, wherein, the products of combustion discharged from the fluidized bed of the first furnace are passed through the second furnace for additional combustion of any combustible solids elutriated from the bed of the first furnace.

* * * * *